United States Patent [19]

Hänsch

[11] Patent Number: 4,903,908

[45] Date of Patent: Feb. 27, 1990

[54] METHOD OF, AND APPARATUS FOR, PROCESSING FLAT PRODUCTS, ESPECIALLY FOLDED PRINTED PRODUCTS, ARRIVING IN AN IMBRICATED FORMATION

[75] Inventor: Egon Hänsch, Wetzikon, Switzerland

[73] Assignee: Ferag AG, Hinwil, Switzerland

[21] Appl. No.: 169,044

[22] Filed: Mar. 16, 1988

Related U.S. Application Data

[63] Continuation of Ser. No. 497,142, May 23, 1983, abandoned.

[30] Foreign Application Priority Data

Jun. 3, 1982 [CH] Switzerland ..... 3411/82

[51] Int. Cl.[4] ..... B65H 29/70; B65B 63/04

[52] U.S. Cl. ..... 242/59; 53/118; 53/430

[58] Field of Search ..... 242/59, 55, 67.1 R; 53/118, 430; 271/3, 3.1, 9, 184, 186, 187, 204, 207, 216, 225, 227; 194/DIG. 26; 198/347

[56] References Cited

U.S. PATENT DOCUMENTS

| | | | |
|---|---|---|---|
| 3,659,699 | 5/1972 | Donahue et al. | 271/76 |
| 3,735,977 | 5/1973 | Reist | 271/75 |
| 4,010,945 | 3/1977 | Kistner | 271/151 |
| 4,063,693 | 12/1977 | Achelpohl et al. | 242/67.1 R |
| 4,438,618 | 3/1984 | Honegger | 53/430 |
| 4,525,982 | 7/1985 | Meier | 242/59 |
| 4,526,362 | 7/1985 | Thierstein | 242/59 |
| 4,575,988 | 3/1986 | Meier | 242/55 |
| 4,595,192 | 6/1986 | Reist | 242/59 |

FOREIGN PATENT DOCUMENTS

| | | |
|---|---|---|
| 1011219 | 11/1965 | United Kingdom . |
| 1035862 | 7/1966 | United Kingdom . |
| 1058041 | 2/1967 | United Kingdom . |
| 1246220 | 9/1971 | United Kingdom . |
| 1275674 | 5/1972 | United Kingdom . |
| 2024176 | 1/1980 | United Kingdom . |
| 2092557 | 8/1982 | United Kingdom . |

*Primary Examiner*—Stuart S. Levy
*Assistant Examiner*—Katherine Matecki
*Attorney, Agent, or Firm*—Fleit, Jacobson, Cohn, Price, Holman & Stern

[57] ABSTRACT

The imbricated product formation is unwound from a first product package and infed to a deflection device in which the imbricated product formation is inverted by turning the same over through an angle of approximately 180° about the rotational axis of a deflecting drum. The inverted imbricated product formation leaving the deflection device is inputted from below to a winding core to be wound-up thereon to form a second product package. By inverting the imbricated product formation due to its passage through the deflection device there is achieved the result that in the imbricated product formation supplied to the winding core the leading edges of the printed products are positioned on top so as to face the second product package. Consequently, a compact second product package is formed in which the printed products are not able to become displaced by slipping.

15 Claims, 3 Drawing Sheets

METHOD OF, AND APPARATUS FOR, PROCESSING FLAT PRODUCTS, ESPECIALLY FOLDED PRINTED PRODUCTS, ARRIVING IN AN IMBRICATED FORMATION

CROSS-REFERENCE TO RELATED APPLICATIONS AND PATENTS

This application is a continuation of the commonly assigned, copending United States application Ser. No. 06/497,142, filed May 23, 1983, entitled "Method of, and Apparatus For, Processing Flat Products, Especially Folded Printed Products, Arriving In An Imbricated Formation", now abandoned which is, related to the following:

(i) the commonly assigned, previously copending U.S. application Ser. No. 06/280,998, filed July 6, 1981, entitled "Apparatus for Stacking Printed Products, such as Newspapers, Periodicals and the Like, Arriving in an Imbricated Product Stream", now U.S. Pat. No. 4,438,618, granted March 27, 1984;

(ii) the commonly assigned, previously copending U.S. application Ser. No. 06/338,568, filed Jan. 11, 1982, entitled "Method and Apparatus for the Long-Term Pressing of Printed Products, Especially Newspapers", now U.S. Pat. No. 4,494,359, granted Jan. 22, 1985;

(iii) the commonly assigned, previously copending U.S. application Ser. No. 06/432,557, filed Oct. 4, 1982, entitled "Apparatus for the Storage of Flat Products Arriving in an Imbricated Formation, Especially Printed Products", now U.S. Pat. No 4,587,790, granted May 13, 1986;

(iv) the commonly assigned, previously copending U.S. application Ser. No. 06/445,564, filed Nov. 29, 1982, entitled "Method of, and Apparatus for, Removing Flat Products, Especially Printed Products, From a Winding Core", now U.S. Pat. No 4,525,982, granted July 2, 1985;

(v) the commonly assigned, previously copending U.S. application Ser. No. 06/445,565, filed Nov. 29, 1982, entitled "Method and Apparatus for Storing Continuously Arriving Flat Products, Especially Printed Products, and Product Package Formed from such Products", now U.S. Pat. No. 4,575,988, granted March 18, 1986; and (vi) the commonly assigned, previously copending U.S. application Ser. No. 06/496,901, filed May 23, 1983, entitled "Method of, and Apparatus For, Processing Flat Products, Especially Printed Products, Arriving in an Imbricated Formation", now abandoned.

BACKGROUND OF THE INVENTION

The present invention relates to a new and improved method of, and apparatus for, processing flat products, especially printed products and preferably folded printed products, arriving in an imbricated product formation or array.

In its more specific aspects, the invention relates . to a new and improved method of, and apparatus for, processing flat products, especially printed products, preferably folded printed products, arriving in an imbricated product formation in which the products are wound-up to form a product package.

While the description to follow, as a matter of convenience, refers to the processing of printed products, obviously other types of products can be conveniently handled, and therefore, the use of this term is not to be construed in a limiting sense in any way whatsoever, merely it is to be viewed as an exemplary and desirable field of application for the inventive measures.

It is known, for example, from German Patent Publication No. 3,123,888 and the cognate British Patent Publication No. 2,081,230, to input the printed products arriving in an imbricated product formation from below to a winding core and to wind-up the same thereon. In principle, compact product packages having considerable diameters can be formed in this manner without any damage to the printed products.

However, when the imbricated product formation to be wound-up is formed such that each product therein rests upon a successive product, i.e. the leading edge of the printed products is positioned on the bottom side of the imbricated product formation, there exists the danger in the case of large diameter product packages that the printed products present in the innermost layers of the product package can become displaced by slipping. Consquently, such printed products may become damaged or at least deformed to such an extent that further mechanical or automatic processing of such products is made more difficult or even becomes impossible. Above all, such problem exists when the imbricated product formation originally contained the products with their leading edges on top and such product formation has been wound-up into a first product package which subsequently is rewound to form a second product package as described, for example, in German Patent Publication No. 3,151,860 and the cognate British Patent Publication No. 2,092,557.

SUMMARY OF THE INVENTION

Therefore, with the foregoing in mind it is a primary object of the present invention to provide a new and improved method of, and apparatus for, processing flat products, especially printed products, preferably folded printed products, arriving in an imbricated product formation in a manner also permitting the formation of faultless larger diameter product packages.

Another important object of the present invention is directed to the provision of a new and improved method of, and apparatus for, processing flat products, especially printed products, preferably folded printed products, arriving in an imbricated product formation, wherein the imbricated product formation can be wound-up in the most simple manner and independent of the relative position of the products within the imbricated product formation.

Still a further significant object of the present invention is directed to a new and improved method of, and apparatus for, processing flat products, especially printed products, preferably folded printed products, arriving in an imbricated product formation, wherein faultless product packages even of larger diameters can be formed even when rewinding the imbricated product formation from one product package to another product package.

Now in order to implement these and still further objects of the invention, which will become more readily apparent as the description proceeds, the method of the present development, among other things, is manifested by the features that, the imbricated product formation, prior to the wind-up operation, is inverted or turned-over such that the top side of the imbricated product formation is positioned so as to form the bottom side thereof.

By inverting the imbricated product formation prior to the wind-up operation it is possible to achieve in a simple manner the result that the leading edge of the product in the imbricated product formation to be wound-up is located on that side of the imbricated product formation which confronts the product package. When inputting the products from below to the product package or, respectively, to the winding core the leading edges are thus placed on top. Consequently, even in the case of product packages having large diameters, the products are now retained in their spatial position within the product package and cannot become displaced by slipping even in the innermost layers of the product package. Damage to and permanent deformations of the products as well as a loosening of the layers in the product package are thus effectively prevented.

The method according to the invention is of advantage above all in such cases in which the imbricated product formation to be wound-up to form a primary product package is stored in the form of an intermediate product package from which the imbricated product formation is unwound for winding-up the primary product package. By inverting the imbricated product formation after unwinding the same from the intermediate product package and prior to the formation of the primary product package there is achieved the result that the products also can be supplied to the primary product package in a position within the imbricated product formation which is required for the build-up of a firm product package.

The products from a rotary printing press usually arrive in an imbricated product formation in which each printed product rests upon the preceding printed product. When such an imbricated product formation is inputted from below to a first product package, the leading edges of the products, which normally are the folded edges, face the winding core or, respectively, the intermediate product package formed thereon. This is desired for the build-up of a firm product package. When the imbricated product formation unwound from such an intermediate product package is inverted prior to winding-up the same on the winding core of the primary product package in the manner according to the invention and is subsequently inputted from below to the winding core of the primary product package, then the leading edges of the products are again positioned on top as required, i.e., the leading edges are located on that side of the imbricated product formation which faces the primary product package.

As alluded to above, the invention is not only concerned with the aforementioned method aspects, but also relates to a novel construction of apparatus for the performance thereof. Generally speaking, the inventive apparatus, among other things, comprises a wind-up station for winding-up the products to form a product package. To achieve the aforedescribed measures the inventive apparatus in its more specific aspects comprises inverting means for turning over or inverting the imbricated product formation such that the top side thereof becomes the bottom side.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
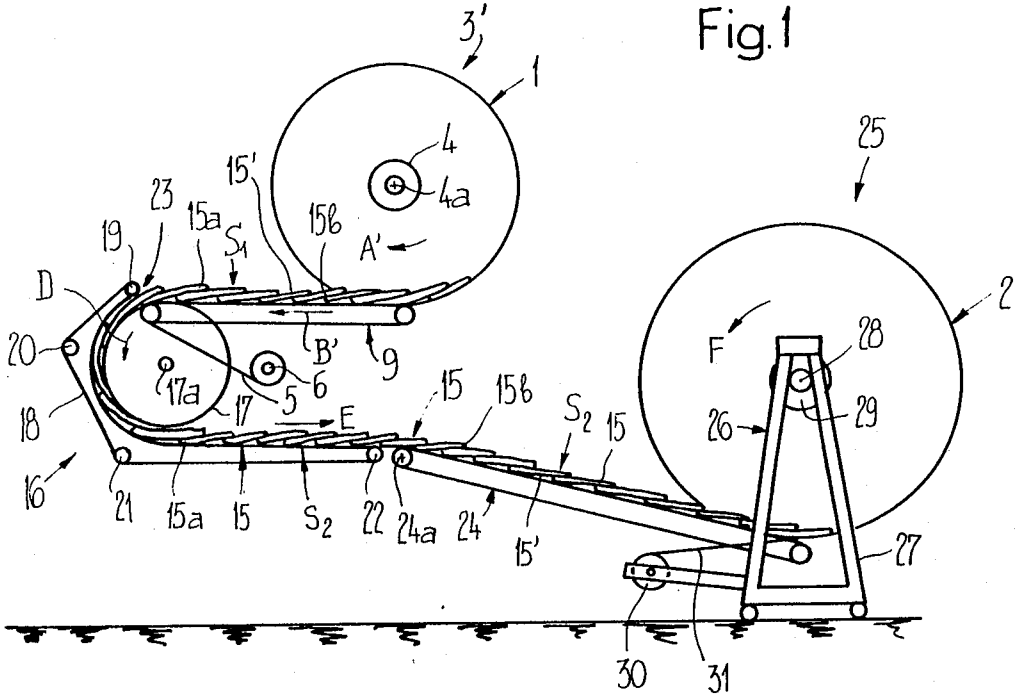
FIG. 1 is a schematic side view of an apparatus constructed according to the present invention for rewinding an imbricated product formation formed by folded printed products from an intermediate product package into a primary product package.

Describing now the drawings, it is to be understood that only enough of the construction of the apparatus for processing flat products or the like has been shown as needed for those skilled in the art to readily understand the underlying principles and concepts of the present development, while simplifying the showing of the drawings. Turning attention now specifically to FIG. 1, there has been schematically illustrated therein an apparatus for rewinding an imbricated product formation from an intermediate product package 1 into a primary product package 2, whereas FIG. 2 shows details of the apparatus for forming the intermediate product package 1. With respect to structure as well as to function the apparatus depicted in FIG. 2 corresponds to the apparatus described in German Patent Publication No. 3,123,888 and the cognate British Patent Publication No. 2,081,230. As will be evident from the Figures of the drawings a stationary winding core 4 is placed at a wind-up location 3 at which the intermediate product package 1 is formed. The stationary winding core 4 is mounted for rotation about its rotational axis **4*a* in any suitable manner not here shown in more detail. One end of a winding band or tape 5 is attached to the winding core 4 and the winding band or tape 5 is unwound from a suitable band or tape supply roll 6. The latter is mounted so as to be freely rotatable about its rotational axis 6*a*. A suitable jaw or friction brake, generally designated by reference numeral 7, and which has only been illustrated schematically, acts upon the supply roll 6. The winding band or tape 5 is guided over a roller 8 and runs along the top side of a belt or band conveyor 9 forming a rocker or balance member which is pivotable about a pivot axis 9*a*. A suitable contact or pressing element 10 acts upon the belt or band conveyor 9 and here comprises, for instance, a contact or pressing rod 11 which is linked to the belt or band conveyor 9. This contact or pressing rod 11 is guided in a stationarily positioned housing 12 which houses a compression spring 13 acting upon the contact or pressing rod 11. The belt or band conveyor 9 is upwardly urged or biased by the contact or pressing element 10 towards the winding core 4 or towards the product package 1** formed thereon, as the case may be.

A further belt or band conveyor 14 is arranged forwardly or upstream of the belt or band conveyor 9 and supplies the printed products 15 to be wound-up in the direction of the arrow C from a suitable source like, for example, a rotary printing press. The folded printed products 15 form an imbricated product formation S in which each printed product 15 rests upon the preceding printed product. This implies that the leading edge **15*a* of the printed products 15, which is formed by the folding or fold edge, is exposed and located on the top side or upper surface of the imbricated product formation S. The trailing edge 15b of the printed products 15 is overlapped or covered by the printed product lying on top. The top side or upper surface of the printed products 15 in the imbricated product formation S has been designated by reference numeral 15'**.

In principle, the winding-up of the imbricated product formation S which is inputted from below to the winding core 4 in the direction of the arrow B occurs in the manner as described in the German Patent Publication 3,123,888 or cognate British Patent Publication No. 2,081,230 mentioned hereinbefore. In a manner not here shown in greater detail the winding core 4 is appropriately driven so as to rotate in the direction of the arrow A, whereby the imbricated product formation S is wound-up on the winding core 4. At the same time the winding band or tape 5 is wound-up between the plies or the layers of the product package. The winding band or tape 5 is wound-up under tension due to the braking action exerted by the jaw or friction brake 7 upon the supply roll 6. Since the leading edges 15a of the printed products 15 lie on top and thus face the winding core 4, as already mentioned, a compact intermediate product package 1 is obtained in which even the printed products in the innermost layers cannot become displaced due to slipping.

Figure 2:
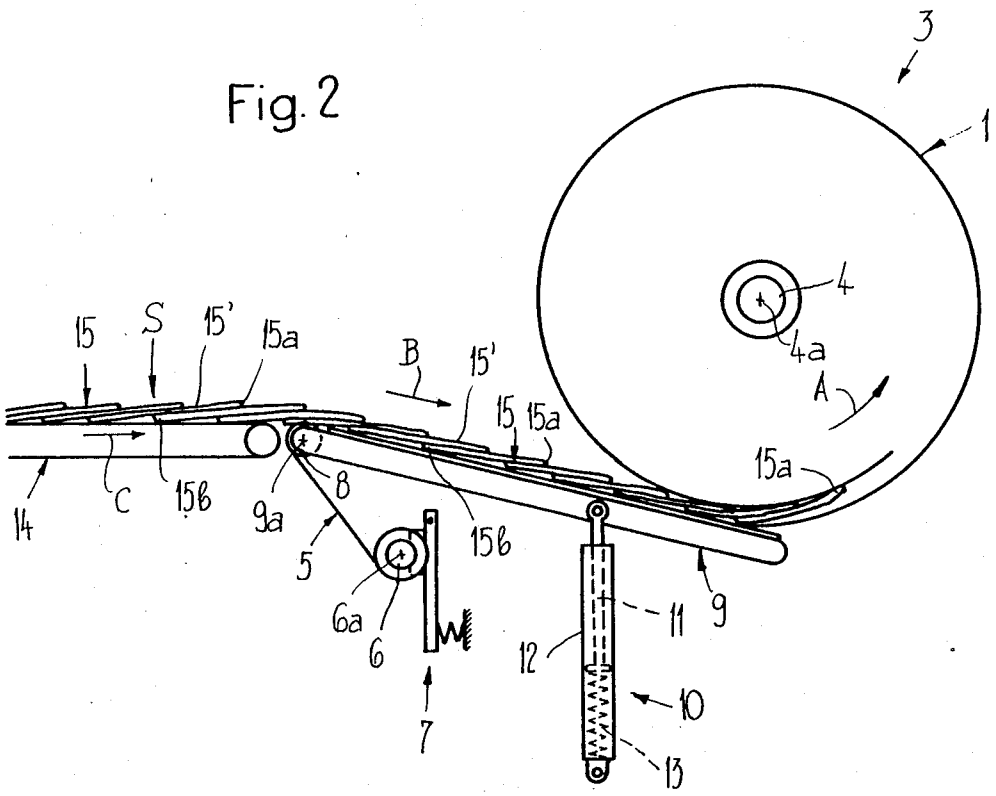
FIG. 2 is a side view on an enlarged scale of the apparatus for forming the intermediate product package in the apparatus shown in FIG. 1.

The apparatus as shown in FIG. 1 for rewinding the printed products from the intermediate product package 1 formed in the manner as described hereinbefore in order to form the primary product package 2 comprises deflecting or deflection means 16 following the belt or band conveyor 9. The deflecting means or deflection device 16 comprises a deflecting or deflection drum 17 driven in any suitable manner for rotation about its axis 17a in the direction of the arrow D. A run or strand of an endless support band or belt 18 extends along part of the circumference of the deflecting drum 17 and at a distance therefrom. The support band 18 is guided by guide rollers 19, 20, 21 and 22 in an endless loop and is driven in the direction of the arrow E. The run or strand of the support band 18 extending between the guiding or guide rollers 19 and 22 together with the deflecting drum 17 defines a conveying gap or space 23.

A belt or band conveyor 24 follows the deflecting or deflection means 16 which, like the belt or band conveyor 9, is designed as a rocker or balance member and which is pivotable about an axis 24a. Again, a suitable contact or pressing element, which may be like the contact or pressing element 10 of FIG. 2, and not particularly shown in FIG. 1, acts upon the belt or band conveyor 24, and urges this belt or band conveyor 24 towards the primary product package 2. The belt or band conveyor 24 takes-over the printed products from the support band 18 and supplies the same to a wind-up station 25.

A wind-up and storage unit 26 as described in greater detail in the German Patent Publication 3,236,866 and the cognate British Patent Publication No. 2,107,681, is located at the wind-up location or station 25. Reference is made to the aforementioned publications for a more precise description of the structure and the mode of operation of the wind-up and storage unit 26. This wind-up and storage unit 26, however, will be seen to comprise a mobile frame or frame unit 27 which has the form of a bearing block or pedestal or equivalent structure. A shaft 28 of a winding core 29 is journalled therein for rotation. The winding core 29 is suitably driveable in a manner not here shown in more detail in the direction of the arrow F. Furthermore, a band spool 30 equipped with a winding band or tape 31 is journalled in the frame 27. One end of the winding band or tape 31 is fixedly connected to the winding core 29. Furthermore, braking means (not shown) are present and serve to hold under tension the winding band or tape 31 as it is withdrawn from the band spool 30 when the winding core 29 is rotated.

The mode of operation of the rewinding apparatus shown in FIG. 1 is as follows:

The imbricated product formation is unwound from the intermediate product package 1 at an unwinding station 3' by appropriately driving the supply roll 6 in a manner not here shown in detail. The winding core 4 which is freely rotatable in the direction of the arrow A' is under a light braking action during this operation. The unwound imbricated product formation $S_1$ is supplied to the deflecting means or deflection device 16 in the direction of the arrow B' by the belt or band conveyor 9 and by the winding band or tape 5 wound-up on the supply roll 6. Contrary to the original imbricated product formation S (see FIG. 2) the leading edges in the unwound imbricated product formation $S_1$ are now the edges 15b located on the bottom side.

The unwound imbricated product formation $S_1$ is conveyed by the belt or band conveyor 9 so as to enter the conveying gap or space 23 in the deflecting means 16. Due to the latter the unwound imbricated product stream $S_1$ is inverted or turned over through an angle of substantially 180° about the rotational axis 17a of the deflecting drum 17. The inverted imbricated product formation $S_2$ leaving the conveying gap 23 is conveyed in a conveying direction E which is opposite to the conveying direction B' of the infed unwound imbricated product formation $S_1$. Each printed product 15 in the inverted imbricated product stream $S_2$ leaving the deflecting means 16 now is again placed on the immediately preceding printed product 15, i.e. the leading edge 15b is now placed on the top side or upper surface of the inverted imbricated product formation $S_2$. However, the leading edge 15b is no longer the fold edge 15a as in the original arriving imbricated product stream S (see FIG. 2) but now is formed by what previously was the trailing edge in the original arriving imbricated product stream S. Furthermore, the side 15' of the printed products 15 which was positioned on top in the original arriving imbricated product stream S is now located on the bottom side or bottom in the inverted imbricated product stream $S_2$. The inverted imbricated product formation or stream $S_2$ is supplied by the belt or band conveyor 24 to the winding core 29 which is driven so as to rotate in the direction of the arrow F and is wound-up thereon so as to form a primary product package 2. The winding band or tape 31 is wound-up intermediate the plies or layers of the primary product package 2. When the wound-up primary product package 2 has been completed the wind-up and storage unit 26 is exchanged for another wind-up and storage unit having an empty winding core 29.

By inverting the unwound imbricated product formation $S_1$ obtained from the intermediate product package 2 by using the deflecting or deflection means 16 as aforedescribed the leading edges 15b of the printed products 15 in the imbricated product stream $S_2$ to be wound-up to form the primary product package 2 are caused to also confront the winding core 29 as is desired for the formation of a compact or firm primary product package 2.

For further processing the printed products 15 stored in the primary product package 2 they are again removed from the primary product package 2 at any suitable location or station. When there is desired an imbricated product formation in which the printed products 15 precisely assume the same relative position as in the originally arriving imbricated product stream S shown in FIG. 2, then the imbricated product formation unwound from the primary product package 2 will have to be inverted once again, something which can be readily effected, for example, by using deflecting means corresponding to the deflecting means 16.

In the following description some of the various possible modifications of the apparatus shown in the drawings and explained hereinbefore will be mentioned.

It may not be required, for example, to form the intermediate product package 1 at the same location at which it again will be unwound. In fact, the intermediate product package 1 can be formed at any place and then moved to the unwinding station or location 3'. In such case there is preferably used a wind-up and storage unit like the wind-up and storage unit 26 for the preparation of the intermediate product package 1. Correspondingly, it is also feasible to not provide the winding core 29 for the formation of the primary product package 2 in a mobile frame or frame unit 27, but to stationarily support the same at the wind-up station or location 25.

Instead of being unwound from an intermediate product package 1 the imbricated product formation $S_1$ also may be supplied from a different source to the deflecting means 16.

Figure 3:
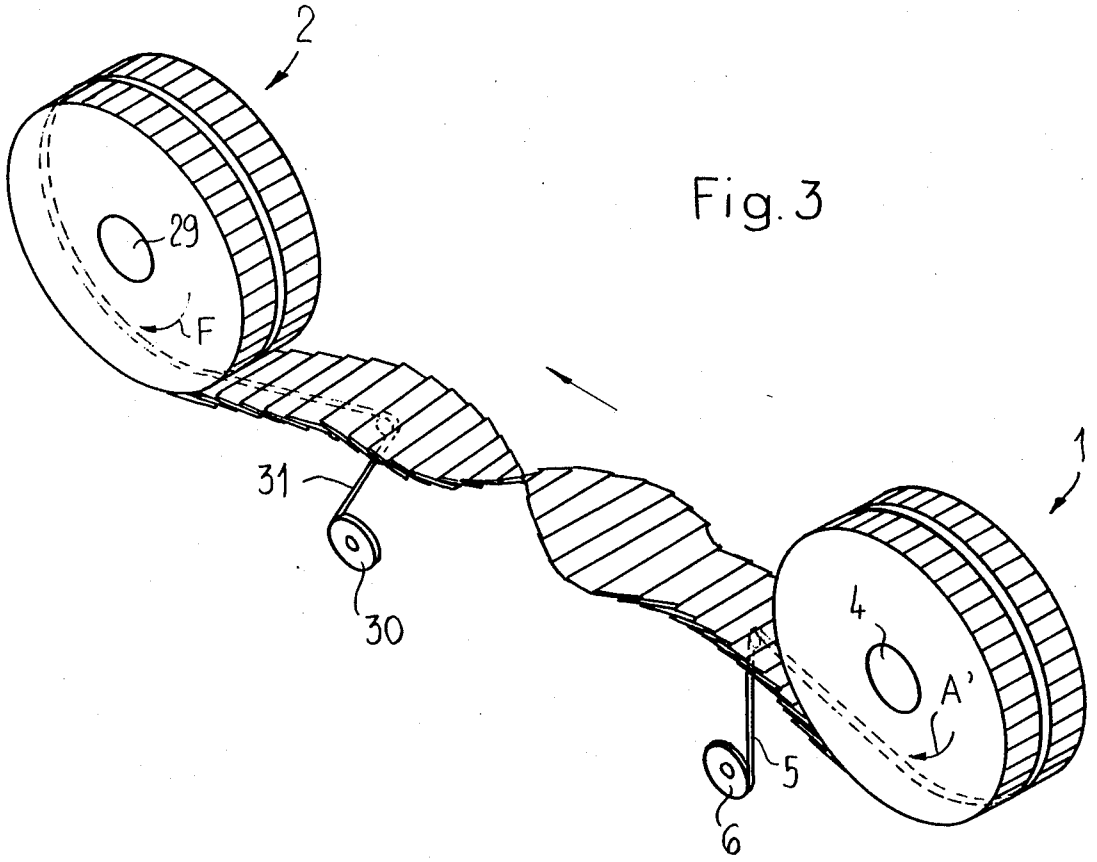
FIG. 3 is a perspective view of an apparatus for inverting the imbricated product formation about the longitudinal axis of the imbricated product formation which extends in the conveying direction thereof.

Inverting the imbricated product formation $S_1$ by the deflecting means 16 as shown and described hereinbefore enables the realization of a space-saving construction. However, it is also conceivable to invert the imbricated product formation $S_1$ in any other suitable manner like, for example, by turning over the same through an angle of about 180° about the longitudinal axis of the imbricated product formation which extends in the conveying direction thereof. An example of such an inverting means is illustrated in FIG. 3 of the drawings. Such inverting means are also known, for example, from U.S. Pat. No. 3,735,977 and the cognate Swiss Patent No. 530,926.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of processing essentially flat products, such as printed products and especially folded printed products, comprising the steps of:

infeeding said products in the form of an imbricated product formation in which each product of said products rests upon a preceding one of said products, winding up said infed imbricated product formation in underfeed in order to form an intermediate product package;

unwinding said intermediate product package in order to form an unwound imbricated product formation in which each product of said products rests upon a subsequent one of said products;

inverting said unwound imbricated product formation such that an upper side thereof becomes a lower side thereof and each product rests upon a preceding one of said products; and winding up said inverted unwound imbricated product formation in underfeed in order to form a primary product package.

2. The method as defined in claim 1, further including the steps of:

conveying said unwound imbricated product formation in a conveying direction in which a longitudinal axis of said imbricated product formation extends; and carrying out the inverting step by deflecting said unwound imbricated product formation through an angle of substantially 180° about an axis extending transversely relative to said longitudinal axis.

3. The method as defined in claim 2, wherein:

said step of deflecting said unwound imbricated product formation through said angle of substantially 180° entails deflecting said unwound imbricated product formation about an axis extending substantially normally relative to said longitudinal axis.

4. The method as defined in claim 1, further including the steps of:

conveying said unwound imbricated product formation in a conveying direction in which a longitudinal axis of said imbricated product formation extends; and carrying out the step of inverting said unwound imbricated product formation by turning the same over through an angle of substantially 180° about said longitudinal axis.

5. A method of processing essentially flat products, such as printed products and especially folded printed products, comprising the steps of:

infeeding said products in the form of an imbricated product formation in which each product of said products rests upon a preceding one of said products;

winding up said infed imbricated product formation in underfeed in order to form an intermediate product package;

unwinding said intermediate product package in order to form an unwound imbricated product formation in which each product of said products rests upon a subsequent one of said products;

inverting said unwound imbricated product formation such that an upper side thereof becomes a lower side thereof; and winding up into coil layers said inverted unwound imbricated product formation such that leading edges of each product of the inverted unwound imbricated product formation are innermost in each coil layer in order to form a primary product package.

6. A method for processing essentially flat products, especially folded printed products and the like, comprising the steps of:

conveying products in an imbricated product formation with each one of said products overlying a preceding one of said products such that leading edges of said products are in an uppermost position in said conveyed imbricated product formation;

winding up said conveyed imbricated product formation in underfeed in order to form an intermediate product package;

unwinding said intermediate product package in order to form an unwound imbricated product formation in which the leading edges of said products are in a lowermost position;

inverting said unwound imbricated product formation by turning said unwound imbricated product formation through an angle of rotation of substantially 180° about an axis essentially parallel to said unwound imbricated product formation to form an inverted unwound imbricated product formation in which the leading edges of said products are in an uppermost position in said inverted unwound imbricated product formation;

delivering said inverted unwound imbricated product formation to a primary winding station; and winding up said delivered imbricated product formation at said primary winding station in underfeed to form a primary product package in which said leading edges are innermost in each coil layer formed upon said primary product package from said delivered imbricated product formation.

7. A method of processing essentially flat products, such as printed products and especially folded printed products comprising the steps of:

infeeding said products in the form of an imbricated product formation in which each product of said products rests upon a preceding on of said products;

winding up said infed imbricated product formation in order to form an intermediate product package;

unwinding said imbricated product formation from said intermediate product package in order to form an unwound imbricated product formation;

inverting said unwound imbricated product formation such that an upper side thereof becomes a lower side thereof; and winding up said inverted unwound imbricated product formation in underfeed in order to from a primary product package.

8. An apparatus for processing essentially flat products, such as printed products and especially folded printed products, comprising:

means for infeeding said products in the form of an imbricated product formation in which each product of said products rests upon a preceding one of said products;

an intermediate wind-up station means for winding up in underfeed said infed imbricated product formation;

wind-up station means for receiving and unwinding said intermediate product package and for winding up a primary product package;

said wind-up station means containing means for unwinding said intermediate product package in order to form an unwound imbricated product formation in which each product of said products rests upon a subsequent one of said products;

means for inverting said unwound imbricated product formation such that an upper side thereof becomes a lower side thereof;

said inverting means being arranged downstream of said intermediate product package at said wind-up station means; and input means following said inverting means and for delivering said inverted unwound imbricated product formation at said wind-up station means for winding up in underfeed said primary product package.

9. The apparatus as defined in claim 8, further including:

conveying means at said wind-up station means for conveying the unwound imbricated product formation in a predetermined conveying direction from said intermediate product package to said inverting means;

said imbricated product formation having a longitudinal axis extending in said predetermined conveying direction; and said inverting means comprising deflecting means for deflecting said conveyed unwound imbricated product formation by substantially 180° about an axis extending transversely relative to said longitudinal axis.

10. The apparatus as defined in claim 9, wherein:

said axis about which said conveyed unwound imbricated product formation is deflected extends substantially normally relative to said longitudinal axis.

11. The apparatus as defined in claim 9, wherein:

said deflecting means comprise a rotatable deflecting drum rotatable about its lengthwise axis and an endless, revolving support band extending over part of the circumference of said deflecting drum at a distance therefrom in order to define together with said deflecting drum a conveying gap for throughpassing the conveyed unwound imbricated product formation;

said unwound imbricated product formation entering said conveying gap in a first conveying direction and an inverted unwound imbricated product formation leaving said conveying gap in a second conveying direction extending oppositely to said predetermined conveying direction;

said inverted unwound imbricated product formation defining a top side and leading edges of an imbricated arrangement of the products forming the inverted unwound imbricated product formation; and said inverted unwound imbricated product formation having a configuration in which the leading edges of the products are located on said top side of the inverted unwound imbricated product formation.

12. The apparatus as defined in claim 8, further including:

conveying means for conveying the unwound imbricated product formation in a predetermined conveying direction;

said conveyed unwound imbricated product formation having a longitudinal axis extending in said predetermined conveying direction; and said inverting means comprising turning means for turning over said conveyed unwound imbricated product formation by approximately 180° about said longitudinal axis.

13. An apparatus for processing essentially flat products, such as printed products and especially folded printed products, comprising:

means for infeeding said products in the form of an imbricated product formation in which each product of said products rests upon a preceding one of said products;

an intermediate wind-up station means for winding up said infed imbricated product formation;

said intermediate wind-up station means winding up in underfeed said infed imbricated product formation and thereby forming an intermediate product package;

wind-up station means for receiving and unwinding said intermediate product package and for winding up in underfeed a primary product package;

said wind-up station means unwinding said intermediate product package and thereby forming an unwound imbricated product formation in which each product of said products rests upon a subsequent one of said products;

means for inverting said unwound imbricated product formation such that an upper side thereof becomes a lower side thereof, said inverting means being arranged downstream of said intermediate product package; and input means for delivering said inverted unwound imbricated product formation at said wind-up station means such that leading edges of said products are situated innermost in each one of coil layers forming said primary product package.

14. An apparatus for processing essentially flat products, especially folded printed products and the like, comprising:

an unwinding station for unwinding said products from an intermediate storage package to form an unwound imbricated product formation in which said products have leading edges;

inverting means for turning said unwound imbricated product formation through an angle of substantially 180° about an axis essentially parallel to said unwound imbricated product formation to form an inverted unwound imbricated product formation in which said leading edges of said products remain leading edges;

conveyor means uniting said unwinding station with said inverting means;

a winding station for winding up said inverted unwound imbricated product formation to form a primary product package in which said leading edges of said products are innermost in each coil layer formed upon said primary product package from said inverted unwound imbricated product formation; and further conveyor means uniting said inverter means with said winding station.

15. An apparatus for processing essentially flat products, such as printed products and especially folded printed products, comprising:

means for infeeding said products in the form of an imbricated product formation in which each product of said products rests upon a preceding one of said products;

an intermediate wind-up station for winding up in underfeed said infed imbricated product formation and forming an intermediate product package;

unwinding means for unwinding said intermediate product package in order to form an unwound imbricated product formation;

means for inverting said unwound imbricated product formation such than an upper side thereof becomes a lower side thereof, said inverting means being arranged downstream of said unwinding means;

a wind-up station for winding up in underfeed said said inverted unwound imbricated product formation to form a primary product package; and input means for delivering said inverted unwound imbricated product formation to said wind-up station in underfeed.

* * * * *